US005419686A

United States Patent [19]

Wissmann et al.

[11] Patent Number: 5,419,686

[45] Date of Patent: May 30, 1995

[54] FUEL PUMP FOR AN INTERNAL COMBUSTION ENGINE

[75] Inventors: Michael Wissmann, Mettmann; Hans Nickel, Cottenweiler; Roland Schierling, Affalterbach; Roland Adam, Besigheim; Werner Geyer, Waiblingen, all of Germany

[73] Assignee: Andreas Stihl, Waiblingen, Germany

[21] Appl. No.: 92,918

[22] Filed: Jul. 19, 1993

[30] Foreign Application Priority Data

Jul. 18, 1992 [DE] Germany ..... 42 23 756.4

[51] Int. Cl.[6] ..... F04B 17/00; F02B 33/04

[52] U.S. Cl. ..... 417/380; 417/395; 123/73 C

[58] Field of Search ..... 417/395, 380; 123/73 C, 123/509

[56] References Cited

U.S. PATENT DOCUMENTS

| | | | |
|---|---|---|---|
| 2,506,434 | 5/1950 | Quimper | 417/395 |
| 2,542,254 | 2/1951 | Lamb . | |
| 2,959,135 | 11/1960 | Dermond . | |
| 3,153,381 | 10/1964 | Holley | 417/395 |
| 3,424,091 | 1/1969 | Turner | 417/395 |
| 3,805,758 | 4/1974 | May | 417/380 |
| 4,813,391 | 3/1989 | Geyer et al. | 417/395 |
| 4,932,370 | 6/1990 | Schierling et al. | 123/73 C |
| 4,936,267 | 6/1990 | Gerhardy et al. . | |
| 5,239,967 | 8/1993 | Adam | 123/509 |
| 5,259,352 | 11/1993 | Gerhardy et al. | 123/509 |

FOREIGN PATENT DOCUMENTS

| | | |
|---|---|---|
| 826926 | 11/1951 | Germany . |
| 18169 | 1/1960 | Germany . |
| 1941900 | 6/1970 | Germany . |
| 2248584 | 4/1974 | Germany . |
| 3203635 | 3/1983 | Germany . |
| 3817404 | 11/1989 | Germany . |
| 1410375 | 10/1975 | United Kingdom . |

*Primary Examiner*—Richard A. Bertsch
*Assistant Examiner*—Roland G. McAndrews, Jr.
*Attorney, Agent, or Firm*—Walter Ottesen

[57] ABSTRACT

The invention is directed to a fuel pump for an internal combustion engine such as a two-stroke engine in a portable handheld work apparatus such as a motor-driven chain saw or the like. A pump chamber is connected via a suction valve to a fuel feed and via a pressure valve to a pressure line. A pump membrane delimits the pump chamber and is driven by the fluctuating crankcase pressure of the engine which is present in the work chamber. Pump operation free of disturbances over a wide rpm range is attained with the suction valve to the pump chamber being configured essentially as a valve having the shape of a part circle, The pressure valve is disposed approximately at the center of the suction valve and delimits the pump chamber in the stroke direction of the pump membrane.

24 Claims, 8 Drawing Sheets

Fig. 10
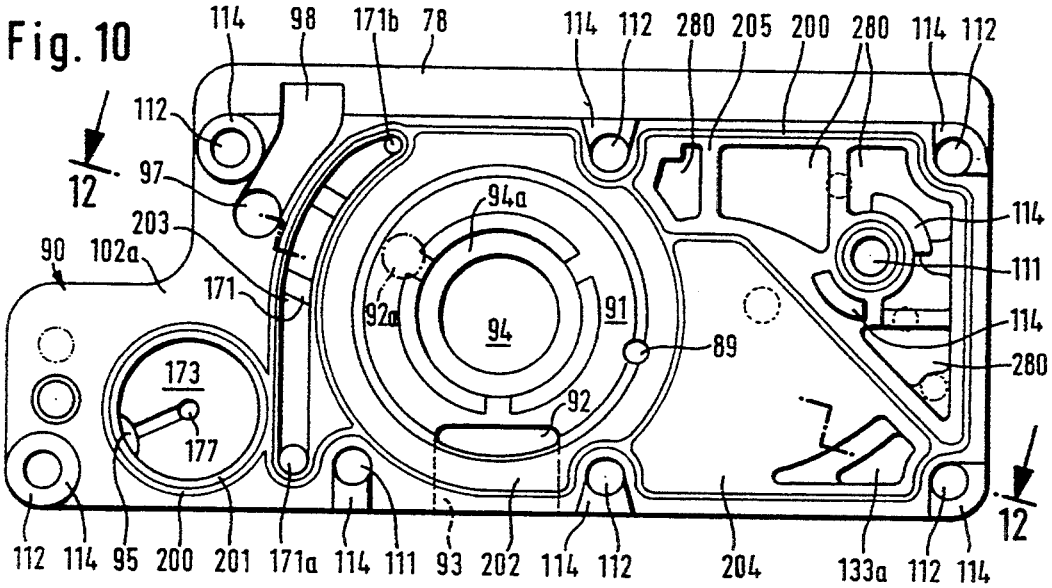
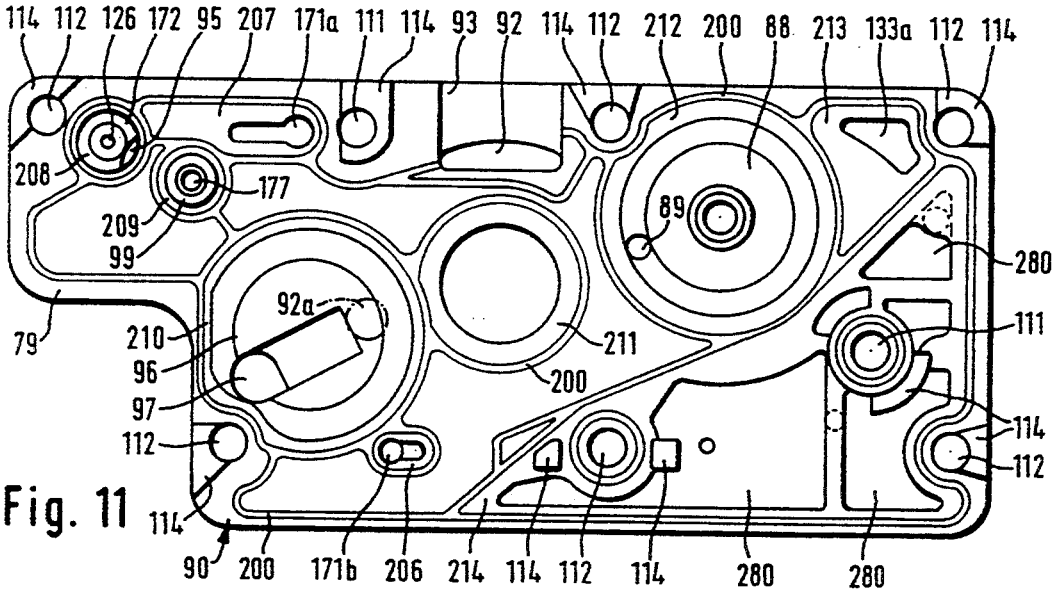
Fig. 11
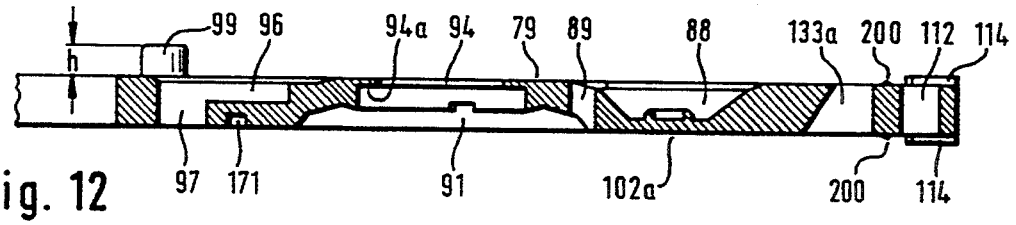
Fig. 12

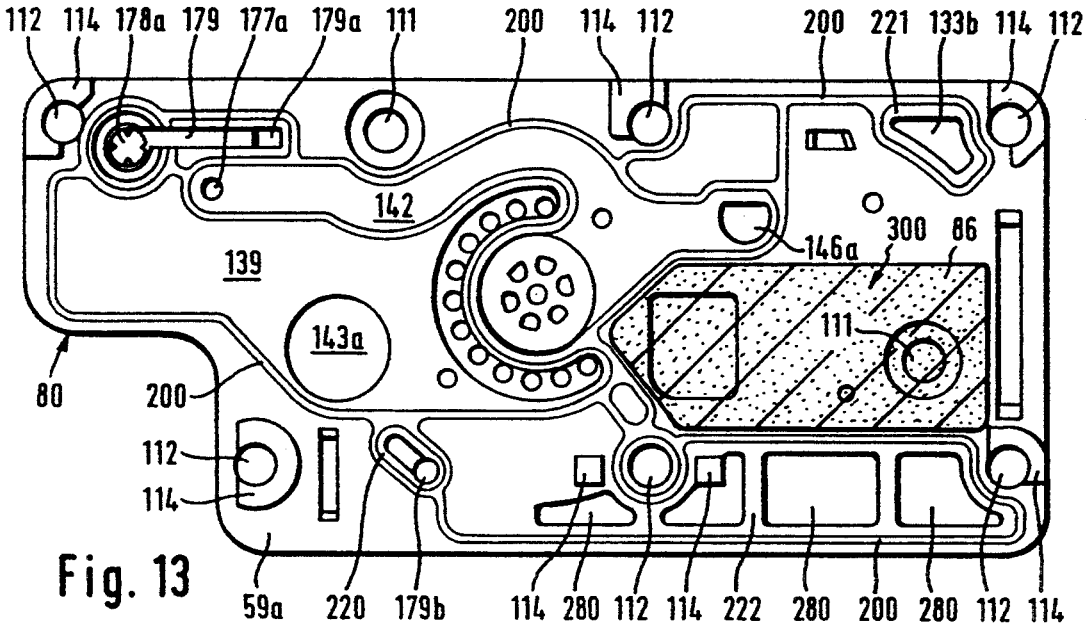
Fig. 13
Fig. 14
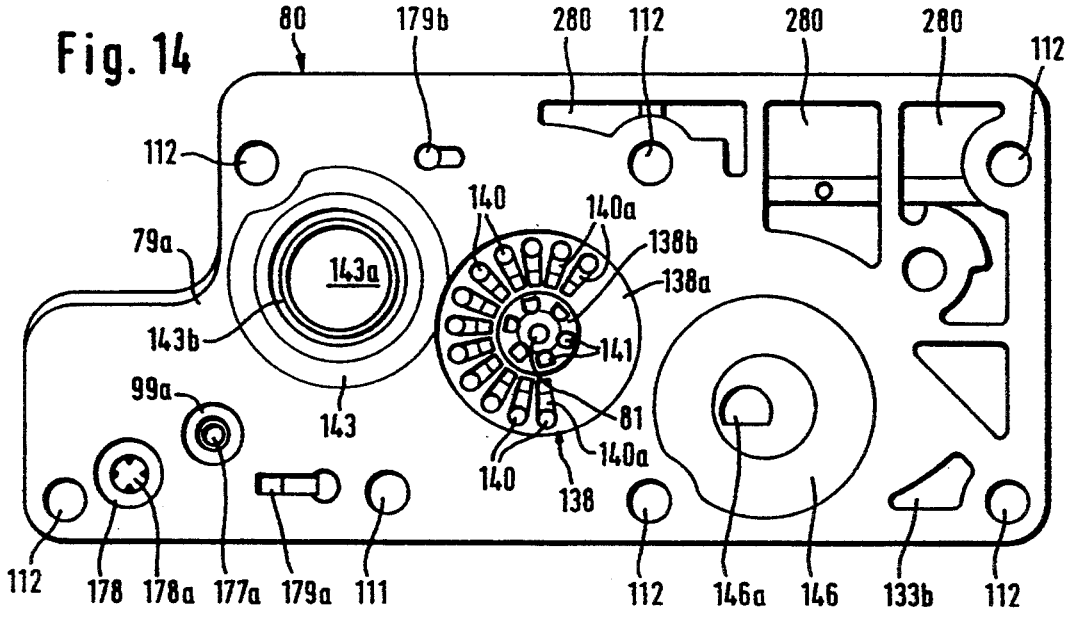

FUEL PUMP FOR AN INTERNAL COMBUSTION ENGINE

FIELD OF THE INVENTION

The invention relates to a fuel pump for an internal combustion engine and especially for a two-stroke engine in a portable handheld work apparatus such as a motor-driven chain saw or the like.

BACKGROUND OF THE INVENTION

A pneumatically driven fuel pump of this kind is disclosed in U.S. Pat. No. 4,936,267. The pump membrane partitions the work chamber from the pump chamber so that the membrane is actuated during the suction stroke directly by the crankcase pressure in the manner of a pump stroke. Fuel is drawn into the pump chamber by suction via the suction valve configured as a check valve and is pumped through the pressure valve into a pressure line. The pressure valve is configured as a check valve. The pressure valve lies diametrically opposite the suction valve referred to the pump chamber so that liquid columns of considerable length have to be accelerated during the suction stroke as well as during the pump stroke. This leads to pumping problems especially at high rpms whereby a deficiency of fuel can occur at the injection pump fed by the pressure line or at a carburetor and this can lead to disturbances.

It has been observed that the rapid change from overpressure to a considerable underpressure at high rpm can cause a pulse-like lifting of the pump membrane whereby vapor bubbles can form which significantly reduce the pumping capacity.

SUMMARY OF THE INVENTION

It is an object of the invention to provide a pneumatically driven fuel pump which is improved in such a manner that a trouble-free pump operation is guaranteed over a wide rpm range.

The fuel pump of the invention is for an internal combustion engine such as a two-stroke engine in a portable handheld work apparatus. The engine has a crankcase wherein pressure fluctuates during operation of the engine and the fuel pump includes: a housing defining an enclosed space; a pump membrane mounted in the housing for delimiting a pump chamber in the space and the pump membrane being movable to reciprocate between first and second positions thereby defining a stroke direction; the housing also defining a work chamber communicating with the crankcase for charging the work chamber with the pressure in the crankcase; actuation means for translating the fluctuating pressure in the work chamber to a force for moving the pump membrane between the positions; a fuel feed for conducting fuel; a suction valve for connecting the fuel feed to the pump chamber; a pressure line for conducting fuel away from the pump chamber; a pressure valve connecting the pump chamber to the pressure line; the suction valve having a first end connected to the fuel feed and a second end facing toward the pump chamber; the suction valve being formed in the housing so as to be configured essentially along an arc of a circle at the second end; the pressure valve being arranged approximately in the center region of the suction valve so as to be in spaced relationship to the suction valve; and, the pressure valve delimiting the pump chamber in the stroke direction.

The path from the suction valve to the pressure valve is minimized by the structural configuration of the suction valve and of the pressure valve as well as the spatial positions thereof intertwined with each other in which positions the valves delimit the pump chamber in the stroke direction. In this way, the columns of liquid to be accelerated during the stroke of the pump membrane can be held to be very small. The guarantee is provided that an acceleration of the liquid columns during the suction stroke is possible even at high rpms. The development of vapor bubbles is effectively countered.

The pump chamber is advantageously configured from a stepped recess in the housing and pass-through openings are introduced in the deeper-lying center of the recess with the pass-through bores being distributed about the periphery. The pass-through bores are closed by a common valve element to form a pressure valve with the common valve element being disposed outside of the pump chamber. Suction openings are introduced in the higher-lying annular step at least over a part of the periphery thereof. These suction openings are closed by a common valve member disposed in the pump chamber. This configuration makes possible the configuration of a relatively small pump chamber whereby a reduced suction capacity is provided which, however, guarantees pumping of the fuel free of vapor bubbles especially at high rpms.

Advantageously, the suction valve is supplied from a suction store which is spatially close to the valve with the suction store being connected to the fuel feed. In this way, the liquid column in the fuel feed between the suction store and an external fuel tank does not have to be accelerated during the intake stroke which would otherwise require a high suction capacity. The suction store thereby substantially compensates for the moderate intake capacity of the fuel pump because of the selected small pump chamber.

A pressure store is arranged on the pressure end of the pressure valve in order to hold the pumped volume of the fuel pump small. The pressure store communicates with the pressure line. The pressure store is so configured that, when utilizing an injection pump, the pump can take the fuel requirement for several injection operations (advantageously 50 injection operations) from the pressure store without it being necessary for the pressure store to be filled by the fuel pump. The arrangement of the pressure store effects a uniformity of the pressure on the pressure side of the fuel pump. In addition, the arrangement of the pressure store makes possible an operation of the fuel pump which is phase shifted to the pump stroke of the injection pump so that the pressure range in the crankcase most favorable for the fuel pump can be utilized independently of the suction stroke of an injection pump.

According to another feature of the invention, a displacement spring is arranged in the pump chamber which applies force to the pump membrane in the direction of a suction stroke via a pump plate. A pump pin lies opposite the pump plate on the dry side of the pump membrane. The pump pin is actuated by a membrane plate which holds a membrane delimiting the work chamber. Since the pump pin of the membrane plate only lies in contact engagement on the membrane, the membrane (especially at high rpm) can lift away from the pump pin because of a sudden underpressure occurring in the work chamber independently of the stroke movement of the pump membrane whereby a formation of vapor bubbles can be countered. The suction stroke itself is carried out by the displacement spring, that is, the suction operation is decoupled from the stroke of the membrane plate over a specific rpm range.

The membrane plate is preferably held in a rest position by counteracting springs. One spring is in the work chamber and at least one more spring is arranged on the side of the membrane facing away from the work chamber. Preferably, the other spring is arranged in the pump chamber and defined by a displacement spring. By selecting the spring constants, an operating point of the membrane can be constructively pregiven which is advantageous for designing the fuel pump.

A decoupling of the work chamber from the pump chamber is obtained by the separation of the pump pin and the pump membrane whereby the pressure surface effective in the work chamber can be configured so as to be greater than the pressure surface of the pump membrane effective in the pump chamber. The high forces occurring during underpressure in the work chamber are attenuated by the spring. For the pumping stroke, a desired pump pumping pressure can be constructively adjusted in a simple manner. If the membrane and the pump pin are made of plastic, then also a thermal decoupling between the work chamber and the pump chamber is obtained.

According to another embodiment of the invention, the fuel pump comprises pump parts preassembled to form an assembly unit and is in the form of plates lying one atop the other and being mutually congruent. These plates essentially comprise a pump cover made preferably of metal, a pump center part made preferably of plastic and a pump lower part made preferably of plastic. The necessary component groups of the fuel pump are configured between the pump parts so that the fuel pump can be preassembled so as to be operationally ready. The necessary connecting openings for the fuel and the pulse line to the crankcase of the internal combustion engine are provided on the housing side of the pump lower part.

BRIEF DESCRIPTION OF THE DRAWINGS

The invention will now be described with reference to the drawings wherein:

FIG. 10 is a plan view of the connecting side of the pump center part with the connecting side facing toward the connecting cover;

FIG. 11 is a plan view of the lower side of the pump center part of FIG. 10 with the lower side facing toward a pump lower part;

FIG. 12 is a section view through the pump center part along the line 12—12 of FIG. 10;

FIG. 13 is a plan view of the housing side of the pump lower part with the housing side facing toward the housing of the injection pump block; and, FIG. 14 is a plan view of the connecting side of the pump lower part with the connecting side facing toward the pump center part.

DESCRIPTION OF THE PREFERRED EMBODIMENTS OF THE INVENTION

Figure 1:
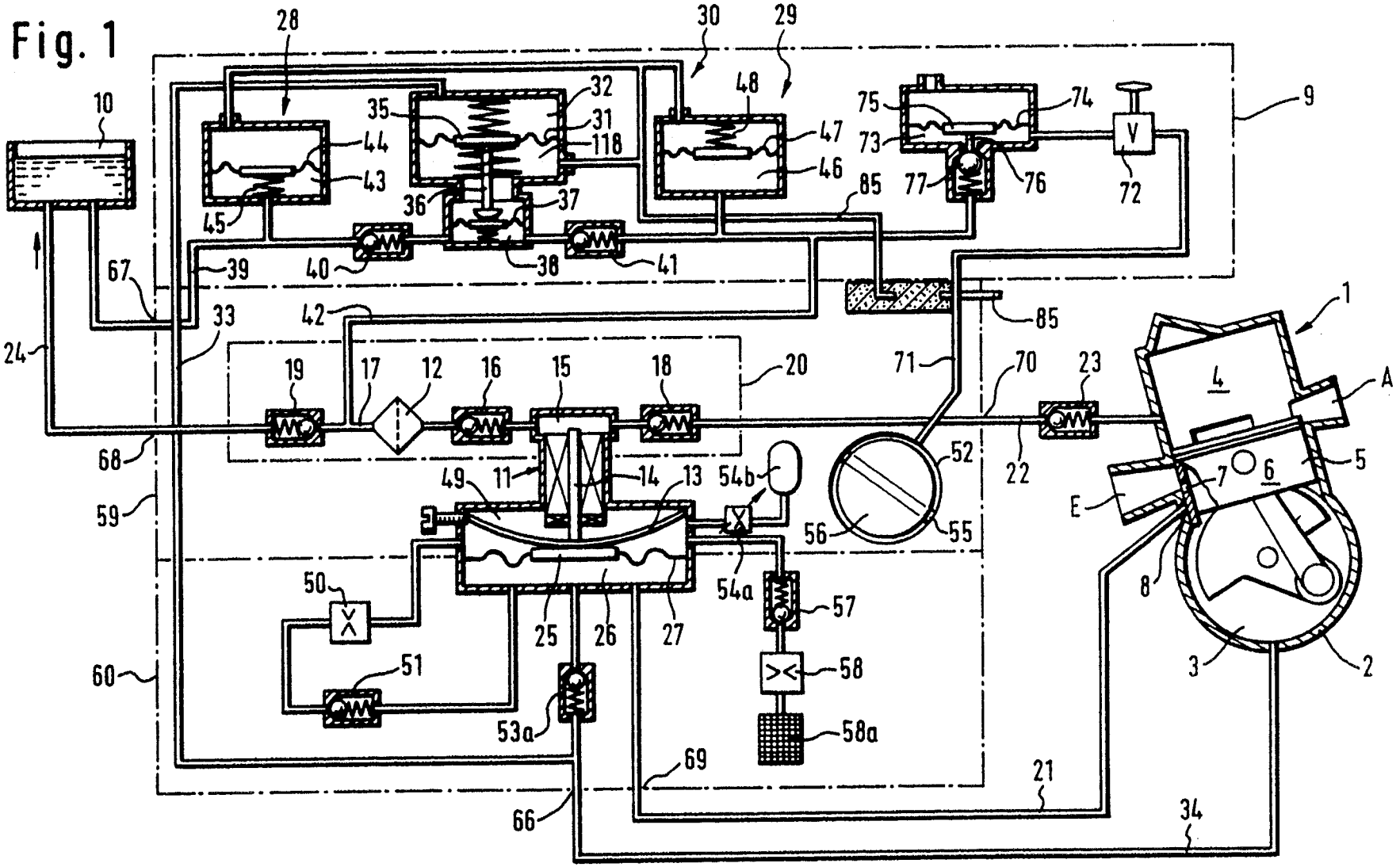
FIG. 1 is a schematic representation of a fuel-injection arrangement for a two-stroke engine equipped with a fuel pump according to the invention.

The fuel-injection arrangement for an internal combustion engine shown schematically in FIG. 1 is especially for a two-stroke engine 1 in a portable handheld work apparatus such as a motor-driven chain saw, cut-off machine, brushcutter or the like. The fuel-injection arrangement comprises essentially a fuel pump 30, an injection pump 11 and a connecting cover 60 for supplying the necessary drive energy to the injection pump 11 and to the fuel pump 30.

The injection pump 11 is integrated into a base housing 59 on which the connecting cover 60 as well as the fuel pump 30, which is premanufactured as a component, are assembled. The base housing 59, the integrated injection pump 11, the built-on fuel pump 30 and the connecting cover 60 conjointly define an injection-pump block 9 (FIG. 2) which is connected to a fuel tank 10 via plug-in connections 67 and 68 on the one hand and is connected to the two-stroke engine 1 on the other hand via the plug-in connections 66 and 69 and the connecting receptacle 70.

The fuel pump 30 is driven via the connecting cover 60 by the crankcase pressure of the two-stroke engine 1. For this purpose, a work chamber 32 delimited by a membrane 31 is provided. The work chamber 32 is connected to the inner space 3 of the crankcase 2 via a pressure channel 33 and the connecting cover 60 as well as the plug-in connection 66 and an external connecting line 34. The pressure channel 33 is configured in the base housing 59. The membrane 31 controls a pump membrane 37 via a membrane plate 35 and a pin 36. The pump membrane 37 delimits the pump chamber 38. The pump chamber 38 is connected via a suction valve 40 to a fuel feed 39 which supplies fuel from the fuel tank 10. The fuel is supplied to a suction line 17 of the injection pump 11 via a pressure valve 41 and a pressure line 42. The injection pump is arranged in the base housing 59. The pressure line 42 is connected via a fuel filter 12 and a suction valve 16 to an injection-pump chamber 15. When the suction valve 16 is closed, the fuel flows back into the fuel tank 10 via a pressure-holding valve 19 and a fuel return 24. The fuel is under pressure and is pumped by the fuel pump 30. When the suction valve 16 is closed, the fuel-feed pump recirculates the fuel from the fuel tank 10.

A suction store 28 is provided in the fuel feed 39 forward of the suction valve 40 viewed in flow direction in order to compensate for pressure fluctuations in the fuel feed 39. The suction store comprises a compensating chamber 43 delimited by a membrane 44. The side of the membrane 44 facing away from the compensating chamber is charged with atmospheric pressure. A spring 45 is arranged in the compensating chamber 43 and resiliently biases the membrane 44 in a direction for enlarging the compensating chamber 43. An adequate quantity of fuel is made available in the suction store 28 independently of the location of the fuel tank 10. This quantity of fuel is preferably sufficient to cover several suction strokes.

A pressure store 29 is arranged in the pressure line 42 in flow direction after the pressure valve 41. The pressure store 29 has a compensating chamber 46 delimited by a membrane 47. The side of the membrane 47 facing away from the compensating chamber 46 is charged with atmospheric pressure. In addition, a spring 48 is provided on this side which biases the membrane 47 in a direction to reduce the volume of the compensating chamber 46.

Pump fluctuations of the fuel pump 30 driven by the crankcase pressure is compensated by the arrangement of the compensating chambers 43 and 46. A rapid start of the internal combustion engine after a short work pause is especially guaranteed by the pressure store 29 because the pressure side of the fuel pump can be held at a minimum pressure for a time interval bridging the work pause.

Referred to the mounted position as shown in the drawings, the injection pump 11 draws fuel under prepressure into a pump chamber 15 during the downward stroke of the pump piston 14 via the fuel filter 12 and the suction valve 16. The suction valve 16 closes during the upward stroke of the pump piston 14 and the fuel is injected into the combustion chamber 4 of the two-stroke engine via the pressure valve 18, an injection line 22 and an injection valve 23. The suction valve 16, the pressure-holding valve 19, the fuel filter 12, the pump chamber 15 and the pressure valve 18 are all arranged in a common valve housing 20 which is seated seal tight in the base housing 59 of the injection-pump block 9.

The pump piston 14 is actuated by a membrane plate 25 which holds a membrane 27 delimiting a work chamber 26. The work chamber 26 is essentially configured in the connecting cover 60 and is connected via a pulse line 21 and a bore 8 to the inner space 3 of the crankcase 2. The bore 8 is then controlled by a control opening 7 in the piston skirt 6 of the piston 5 delimiting the combustion chamber 4 so that the injection pump 11 injects fuel into the combustion chamber 4 in correspondence to the position of the piston 5.

A leaf spring 13 is mounted in a rear chamber 49 on the side of the membrane 27 facing away from the work chamber 26. The leaf spring 13 determines the rest position of the pump piston 14 and therefore also of the membrane plate 25. The rear chamber 49 is connected via a throttle 50 and a check valve 51 to the work chamber 26. In addition, the work chamber 26 is connected to the crankcase 2 via a check valve **53*a* in flow direction to the inner space 3 of the crankcase 2. The rear chamber 49 is also connected via an adjustable throttle 54*a* to a compensating chamber 54*b* which is configured partially in base housing 59 and partially in the fuel pump 30. The rear chamber 49 is connected via a throttle 58 and an input filter 58*a* to the atmosphere in order to provide a pressure compensation which is needed during load changes. It is useful to also provide a check valve 57 opening in the direction toward the rear chamber 49. The check valves, the throttle and the input filter are advantageously provided in the connecting cover 60**.

The internal combustion engine 1 draws combustion air into the inner space 3 of the crankcase 2 via an intake channel E. The combustion air passes from the inner space 3 into the combustion chamber 4 via overflow channels (not shown) controlled by the piston. The exhaust gases occurring during combustion are directed out of the combustion chamber 4 via the outlet channel A.

Figure 2:
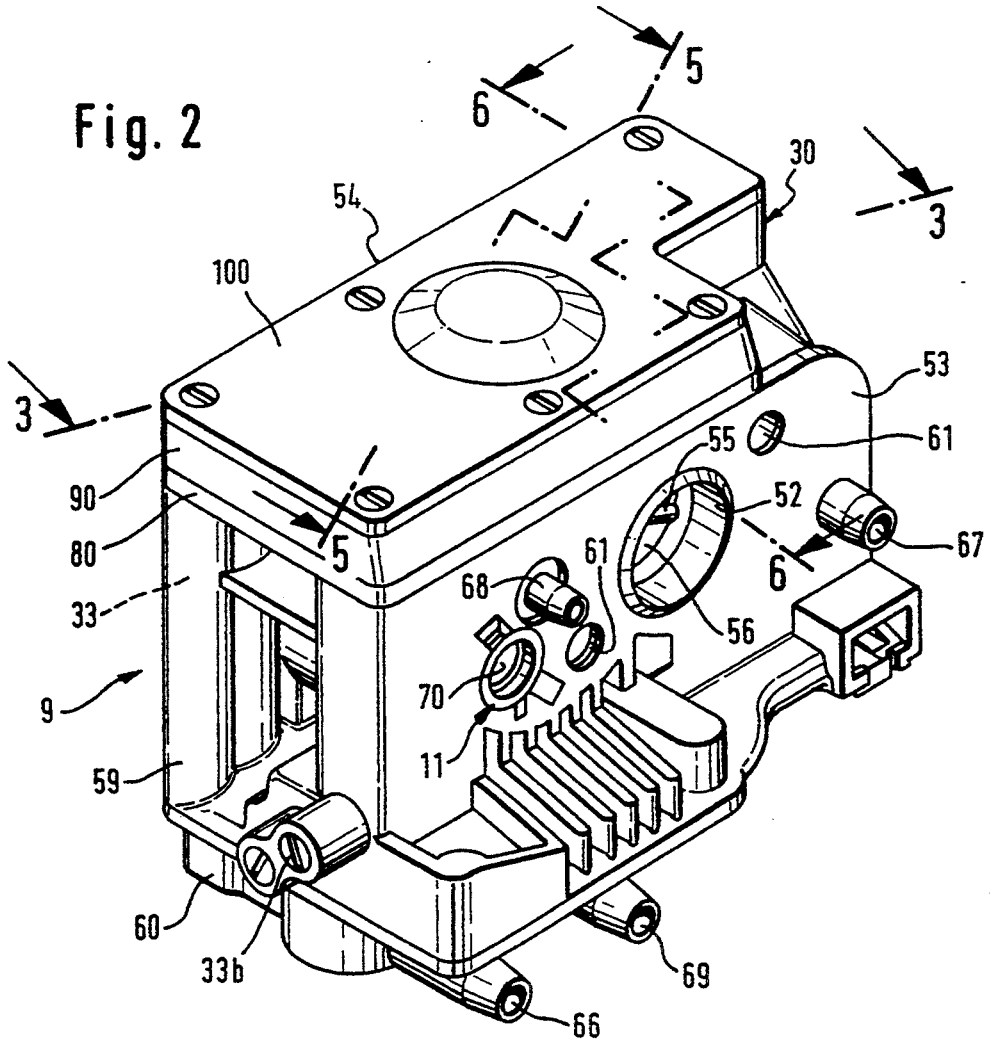
FIG. 2 is a perspective view of a fuel pump attached to a housing of an injection-pump block.

An intake channel section 52 is formed in the base housing 59 (FIGS. 1 and 2) of the injection-pump block 9 made of plastic. The combustion air is supplied to the two-stroke engine 1 via the intake channel section 52. In the embodiment shown, the intake channel section 52 is configured as a channel running along a straight line and extending from one face 53 of the injection-pump block 9 to the other end face 54 thereof as shown in FIG. 2. A throttle flap 56 is pivotally journalled in this channel section 52 on a pivot pin 55. The throttle flap 56 can be actuated by a throttle lever journalled in the housing of the work apparatus via a linkage (not shown). Through bores 61 run parallel to the intake channel section 52 and extend from the one end face 53 to the other end face 54. The bores 61 are provided to accommodate screws for fixing the injection-pump block 9 in the housing of the work apparatus. In addition, adjusting screws are provided for adjusting the throttle.

As shown in FIG. 1, a bypass line 71 is provided in the fuel pump 30 as well as in the base housing 59 and leads to the intake channel section 52. The bypass 71 branches off from the pressure line 42 of the fuel pump 30. A switchable valve 72 is mounted in the bypass line 71 and a control chamber 73 is mounted upstream thereof as shown. The control chamber 73 is delimited by a control membrane 74. The dry side of the control membrane 74 is preferably charged with atmospheric pressure. The membrane plate 75 holding the control membrane 74 has an actuating pin 76 which controls the feed valve 77. The feed valve 77 always opens when the membrane plate 75 drops with the control membrane 74 into the control chamber 73 because of an underpressure which develops in the control chamber. When the feed valve 77 is open, fuel flows from the pressure line 42 via the control chamber 73 to the bypass valve 72 and, when the bypass valve 72 is open, through the further bypass channel 71 to the intake channel section 52.

A disturbance can occur in the injection pump 11, for example, because of air drawn in by suction or because of the formation of vapor bubbles. The internal combustion engine can be started when there are disturbances by opening the bypass valve 72.

As shown in FIGS. 2 to 14, the fuel pump 30 is made of three plate-shaped pump parts 80, 90 and 100 stacked one atop the other. The lower pump part 80 defines the connection to the channel section of the pulse channel 33 which is formed in the base housing 59. The pump lower part 80 further defines the connection to the pressure line 42 as well as to the bypass line 71 to the intake channel section 52. Essentially the pump chamber 38, the suction store 28 and the pressure store 29 as well as the bypass valve 72 and the feed valve 77 are provided between the pump lower part 80 and the pump center part 90. The control chamber 73 for the feed valve 77 and the work chamber 32 of the pulse drive are provided between the pump center part 90 and a pump cover 100.

Figure 7:
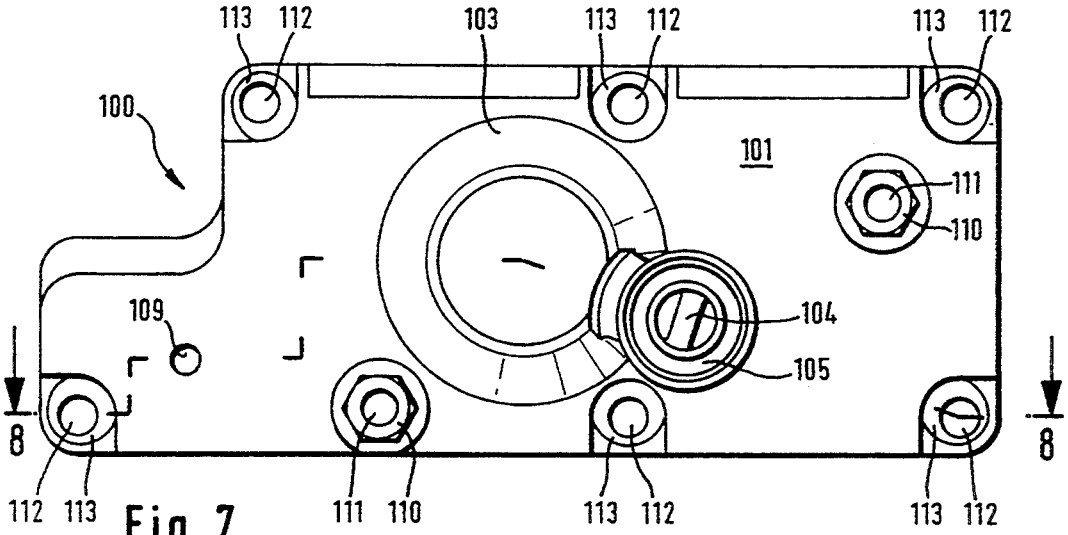
FIG. 7 is a plan view of the outer side of the pump cover of the fuel pump.
Figure 8:
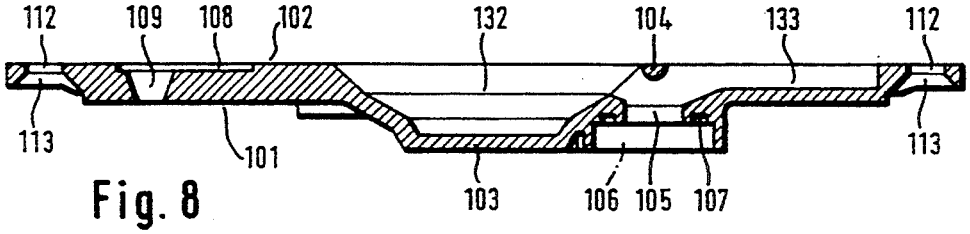
FIG. 8 is a section view taken through the pump cover along the line 8—8 of FIG. 7.
Figure 9:
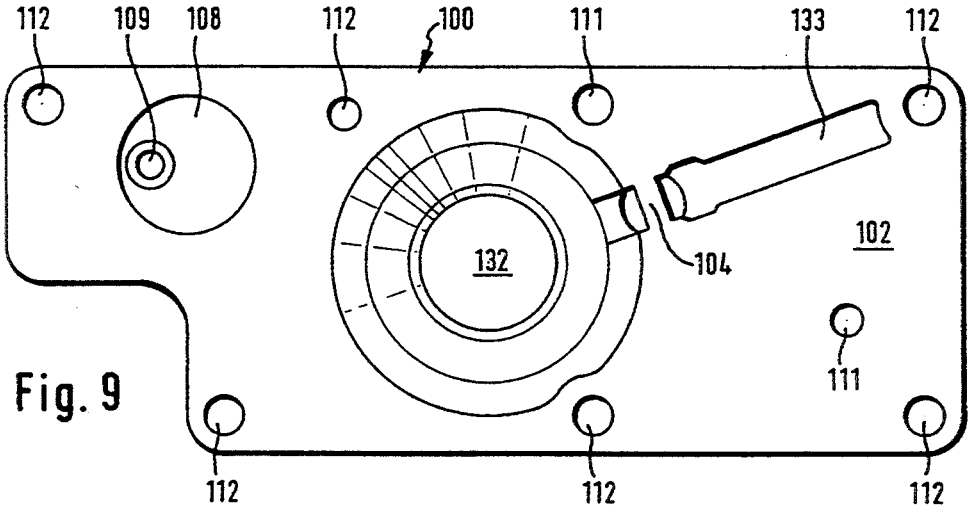
FIG. 9 is a plan view of the inner side of the pump cover of FIG. 7.

The pump cover 100 shown in FIGS. 7 to 9 comprises a good heat-conductive material, preferably a metal such as aluminum, magnesium or an alloy thereof. The pump cover has a conically-shaped hood-like rise 103 on the outer side 101 thereof. The rise 103 is open toward the inside 102 of the cover over its entire surface. The inner space 132 of the rise 103 defines the work chamber 32 of the pulse drive when the fuel pump is assembled.

A groove 133 is formed in the pump cover 100 in the inner side 102 thereof and opens radially into the inner space 132. The groove 133 defines part of the pulse channel 33 when the fuel pump is assembled. A strut 104 is provided to achieve a closed support edge along the periphery of the inner space 132. The strut 104 bridges the groove 133. A cast opening 105 is provided in the outer side 101 opposite the strut 104. The cast opening is closed air tight by a closure cover 106 and a sealing ring 107 after the pump cover has been formed.

A circularly-shaped recess 108 is provided on the inner side 102 of the pump cover 100 in which at least one and preferably several bores 109 are introduced with the bores being open to the outside 101. The recess 108 defines the rear chamber ventilated to the atmosphere. The rear chamber is delimited by the membrane 74 of the control chamber 73.

Figure 5:
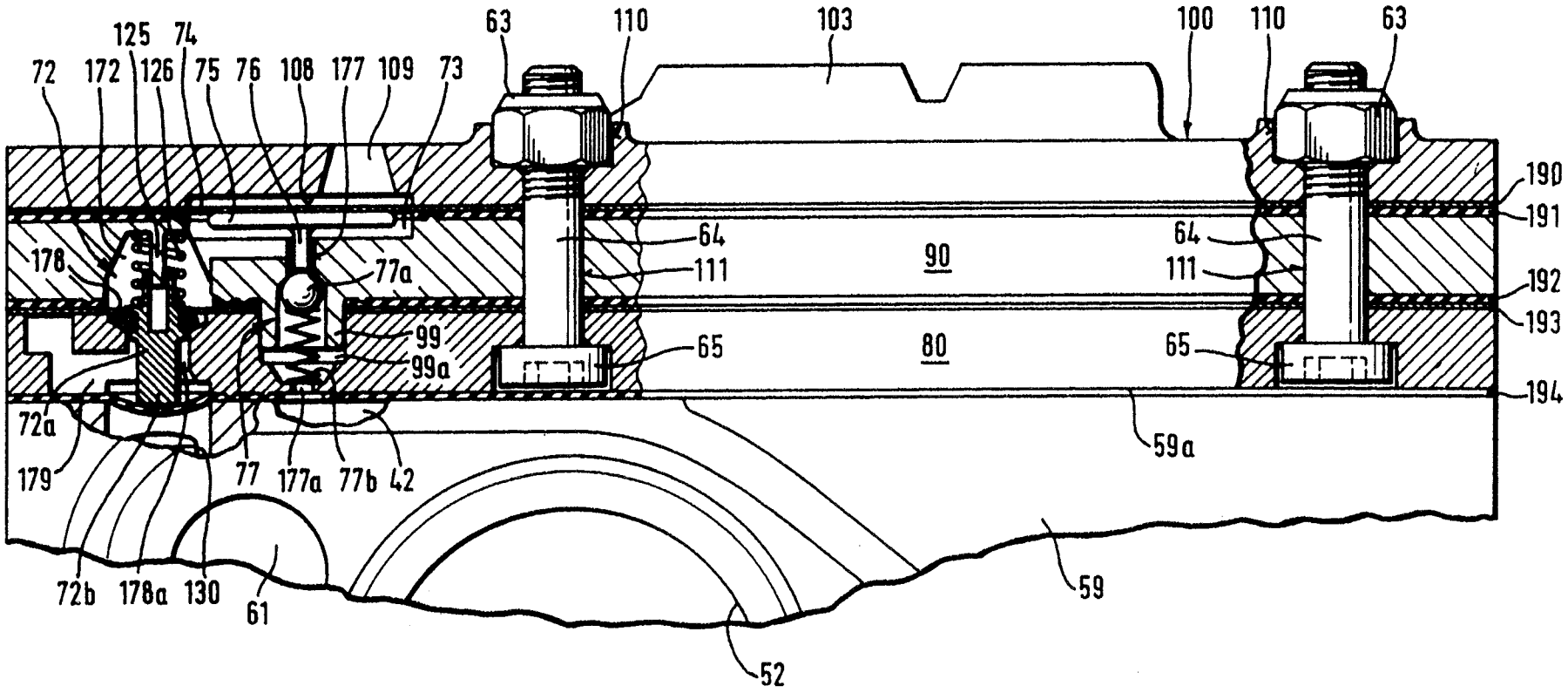
FIG. 5 is a detailed view through the fuel pump along the section line 5—5 of FIG. 2.

On the outside 101, two receptacles 110 are formed in which attachment nuts 63 (FIG. 5) for attachment screws 64 are accommodated so that the nuts 63 are held in a form-tight manner so that they cannot rotate relative to the cover. A through-bore 111 is provided centrally in the receptacle for the attachment screw 64 (FIG. 5). In addition, the cover 100 has through-holes 112 for assembly screws 62. Three assembly screws are provided on each end of the pump cover 100 which has an essentially rectangular shape. The through-holes 112 are provided with recesses 113 on the outside 101 of the cover 100 for receiving the screw heads.

The inner side 102 of the pump cover 100 faces the pump center part as shown in FIGS. 10 to 12 and is provided as a planar sealing surface.

The pump center part 90 is shown in FIGS. 10 to 12 and is made of plastic. The pump center part 90 has a central step-shaped truncated-conical recess 91 on its outer side **102*a* facing toward the pump cover 100. The recess 91 lies opposite the interior space 132 in the pump cover. The truncated-conical recess 91 has a central through-opening 94 which is provided for passing the pump pin 36 (FIG. 1) therethrough. The circularly-shaped through-opening 94 is surrounded by an annular shoulder 94*a* which can serve as a support for a helical spring. The truncated-conical recess 91 can be connected via a venting slot 92 to a venting slot 93. The venting slot 92 is provided in the peripheral region of the recess and the venting slot 93 is provided on the lower side 79 of the pump center part. The vent groove 93 opens to the ambient on the longitudinal side 78 of the pump center part 90 as shown in FIG. 11**.

The recess 108 in the pump cover 100 lies in the connecting side of the pump center part 90 opposite a circularly-shaped recess 173 which defines the control chamber 73 when the pump is assembled. The recess 173 is connected via a central bore 177 to the inner space of the cylinder 99. The inner space lies perpendicularly to the lower side 79. The elevation (h) of the cylinder 99 is less than the thickness of the pump lower part. The recess 173 is connected via a breakthrough 95 to a cup-shaped valve chamber 172. The breakthrough 95 is provided in the peripheral region and the valve chamber 172 is formed on the lower side 79. The valve chamber 172 receives the bypass valve 72 when the pump is assembled.

The connecting side **102*a* of the pump center part 90 is subdivided by struts 200 into fields 201 to 205 separated completely from each other. The recess 173 lies in field 201 and the truncated-conical recess 91 lies in field 202. A stretched field 203 is separated and lies between the fields 201 and 202. A longitudinal groove 171 is provided in the field 203 and extends essentially from the one longitudinal side to the other longitudinal side of the pump center part 90. Perpendicular pass-through openings 171*a* and 171*b* are provided at the ends of the longitudinal groove 171. The through-openings 171*a* and 171*b* open into fields 206 and 207 delimited by sealing struts 200. Two fields 204 and 205 are partitioned by sealing struts on the side of the truncated-conical recess facing away from the longitudinal groove 171. A breakthrough 133*a* is provided in field 204 next to an outer corner of the pump center part. The breakthrough 133*a* is a section of the pulse channel 33 leading to the work chamber of the pulse drive. Several through interruptions 280 are provided in field 205 and define a portion of the compensating volume 54*b*** when the pump is assembled.

Fields 208 to 214 are partitioned by sealing struts on the lower side 79 in the same manner as on the connecting side **102*a*. The valve chamber 172 and the cylinder 99 defining the housing of the feed valve 77 lie in fields 208 and 209, respectively. The through opening 94 of the truncated-conical recess 91 lies in field 211. In FIG. 11, an essentially circular field 210 having a circular recess 96 lies next to the field 211 between the fields 206 and 207. The circular recess 96 is connected via a venting bore 97 to a venting slot 98 lying on the connecting side 102*a*. The venting slot 98 opens to a longitudinal side of the pump center part 90. In lieu of the venting bore 97 and the venting slot 98, the recess 96 can also be connected via a bore 92*a* to the truncated-conical recess 91 in order to be vented to the atmosphere, for example, via venting slot 92 and the venting groove 93**.

In the plan view on the lower side 79 of the pump center part according to FIG. 11, a circular field 212 is partitioned by the sealing strut 200 on the top right next to the field 211. A circular recess 88 is formed in the field 212 which is connected to the truncated-conical recess 91 via a venting bore 89. A field 213 is partitioned between the field 212 and the right-upper edge of the lower side as shown in FIG. 11. The breakthrough **133*a* lies in the field 213. The breakthroughs 280 lie in the remaining field 214**.

As shown in FIGS. 10 and 11, the connecting side **102*a* of the pump center part 90 is configured so as to be narrower in the longitudinal direction than the lower side 79. The one longitudinal side 78** is therefore configured as an incline.

Spacers 114 are provided in the region of the through holes 111 and 112 on the connecting side **102*a* as well as on the lower side 79. The spacers 114** limit the spacing of the pump parts to each other for relieving the sealing layers arranged therebetween.

The pump lower part 80 (FIGS. 13 and 14) has a planar connecting side **79*a* facing toward the pump center part. A two-stepped recess 138 is provided in the connecting side 78*a* which corresponds to the pin through opening 94 and the circular field 211. The center 138*a* of the recess 138 lies deeper and has a central attachment hole 81. Through bores 141 are distributed over the periphery around the central attachment hole 81. The through bores 141 are preferably uniformly spaced one from the other. Suction openings 140 are introduced over a periphery of approximately 220° to 240° and are uniformly distributed. The suction openings 140 are next to the outer edge and in the higher-lying annular shoulder 138***b* of the recess 138. The suction openings 140 open into a fuel feed field on the housing side 59*a* of the pump lower part 80. On the connecting side 79*a*, a suction groove 140*a* leads radially from each suction opening 140 ascending to the center 138*a*. The suction groove 140*a* is open along its entire length to its connecting side 79*a* and the groove bases end at the plane of the annular shoulder 138*b*.

A circular cutout 143 is provided next to the recess 138 and has a large central opening 143*a*. The central opening 143*a* is surrounded by an annular shoulder 143*b* on which the spring 45 of the suction store 28 (FIG. 1) is supported when the pump is assembled. The central opening 143*a* opens, as do suction openings 140, in the fuel feed field 139 which is delimited by sealing struts on the housing side 59*a* of the pump lower part 80. The feed field 139 is connected via the fuel feed 39 and the plug-in connection 67 to the fuel tank 10. The fuel feed 39 is formed in the housing 59.

The cutout 143 lies diametrically opposite a recess 146 referred to the recess 138. The recess 146 communicates with a fuel field 142 via an approximately centrally-lying connecting opening 146*a*. The fuel field 142 is on the housing side 59*a* of the pump lower part 80. The through bores 141 open into the fuel field 142 lying on the pressure side of the fuel pump. The pressure channel 42 leads from the fuel field 142 to the valve housing 20 of the injection pump 11. The pressure channel 42 is configured in the base housing 59.

A cup-shaped receptacle 99*a* is configured on the connecting side 79*a* and the cylinder 99 of the pump center part 90 projects into the receptacle 99*a* when the pump is assembled. The receptacle 99*a* is connected to the fuel field 142 on the pressure side of the fuel pump 30 via a fuel bore 177*a*.

An annular valve seat 178 is configured in the connecting side 79*a* next to the receptacle 99*a*. The annular valve seat lies opposite the valve chamber 172 in the pump center part 90. The valve bore 178*a* opens on the housing side 59*a* into a connecting channel 179 which leads back via a through bore 179*a* to the connecting side 79*a* of the pump lower part. The through bore 179*a* is connected via the trough bore 171*a* to the longitudinal groove 171 when the fuel pump is assembled. The longitudinal groove 171 communicates with the connecting bore 179*b* in the pump lower part. The connecting bore 179*b* opens into a fuel field 220 on the housing side 59*a* from where a nozzle bore 180 (FIG. 6) leads into the intake channel section 52.

A breakthrough 133*b* is provided in the pump lower part 80 and communicates with the breakthrough 133*a* of the pump center part and establishes the connection to the pulse channel in the base housing 59. Correspondingly, the breakthrough 133*b* on the housing side 59*a* lies in a field 221 partitioned by the sealing strut 200. The breakthroughs 280 are arranged in the field 222 in a corresponding manner. The field 222 lies next to a longitudinal side of the pump lower part. Spacers 114 are arranged next to the sealing struts in the region of the through holes (111, 112) on the housing side 59*a* in order to delimit the gap between the housing side 59*a* and the connecting side of the base housing 59.

The pump lower part, the pump center part and the pump cover are preassembled. Assembly screws are inserted into the through bores 111 from the housing lower side 59*a*. The bores 111 are widened at their respective ends on the housing lower side 59*a* for receiving the screw heads 65 as shown in FIG. 5.

Figure 3:
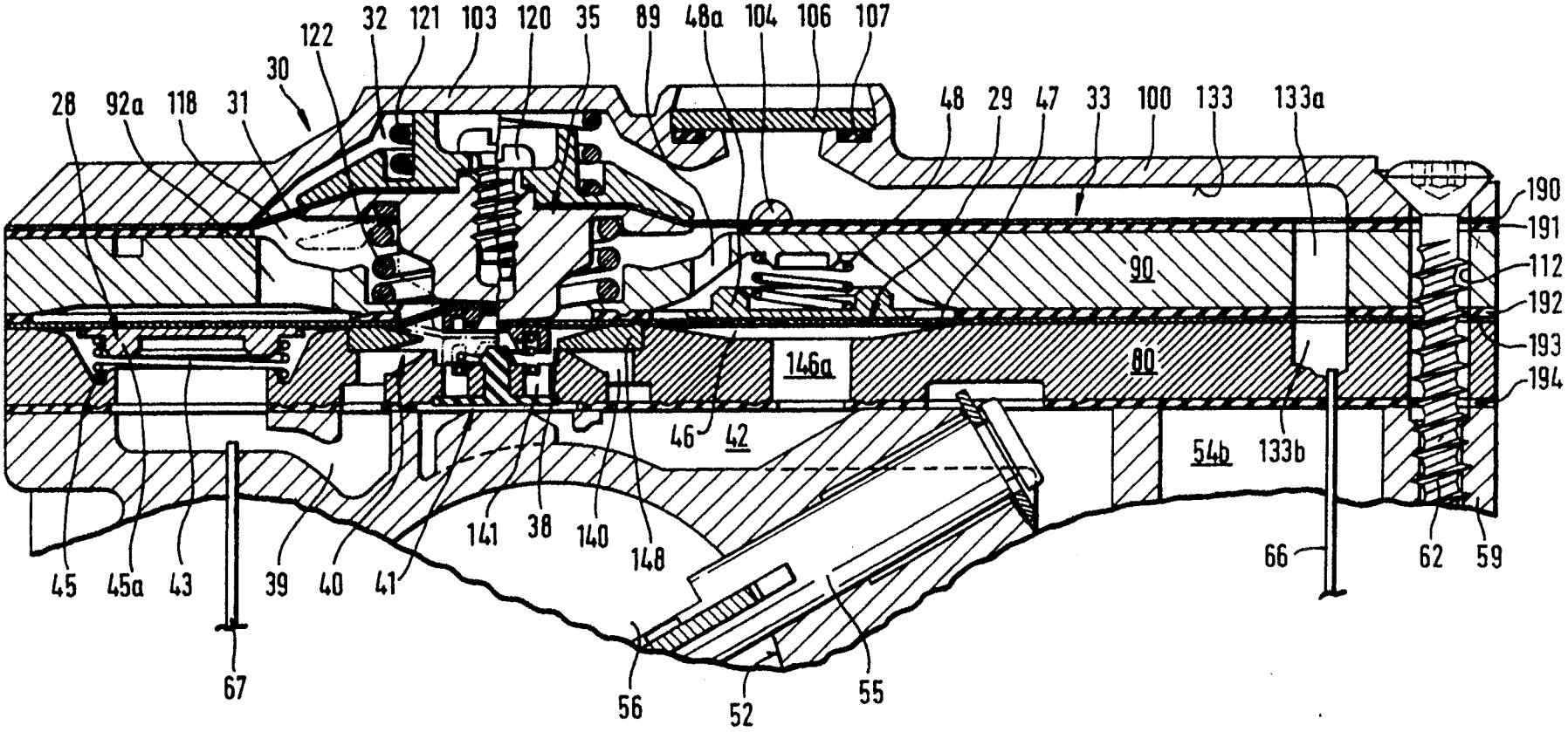
FIG. 3 is a section view taken through the fuel pump along line 3—3 of FIG. 2.

FIG. 3 shows a section through an assembled fuel pump 30. A membrane foil 190 as well as a sealing layer 191 are placed between the pump cover 100 and the pump center part 90. In the same manner, a sealing layer 192 as well as a membrane foil 193 are mounted between the pump center part 90 and the pump lower part 80. A sealing layer 194 is provided between the pump lower part 80 and the housing 59.

The sealing layers 191, 192 and 194 are preferably made of rubber and lie on the respective sides of the pump parts which have the sealing struts 200. Accordingly, a rubber seal 191 is applied to the connecting side 102*a* of the pump center part 90. The rubber seal 191 covers the longitudinal groove 171 but leaves the recess 173, the breakthrough 133*a* and the truncated-conical recess 91 exposed. A membrane foil 190 is applied to the seal 191 so as to be coincident therewith. The membrane foil 190 covers the recess 173 and the truncated-conical recess 91 and leaves only the breakthrough 133*a* exposed. The spacers 114 are advantageously contact engaged by the rubber seal 191 and by the membrane foil 190 so that the spacers 114 at the same time fix the rubber seal 191 and the membrane foil 190.

The rubber seal 192 is applied to the lower side 79 and leaves the following exposed: the valve chamber 172, the pump cylinder 99, the through bore 171*a*, the through bore 171*b*, the pins of the through opening 94, the recess 88 and the breakthrough 133*a*. Breakthroughs 280 are likewise left exposed by the rubber seal 192; whereas, the breakthroughs are covered on the connecting side 102*a* by the seal 191. The membrane foil 193 is coincident and lies between the rubber seal 192 and the pump lower part 180. The membrane foil 193 covers the recess 96, the pin passthrough 94 and the recess 88 so as to be pressure tight and leaves only the breakthrough 133*a*, the fuel bores 171*a* and 171*b*, the valve chamber 172 and the breakthroughs 190 open. The cylinder 99 also projects through the membrane 193. The spacers 114 are also provided on this side and simultaneously position the layer of the rubber seal 192 and the membrane 193. The rubber seal 194 is arranged between the housing 59 and the housing side 59*a* of the pump lower part 80 and covers the valve bore 178*a* as well as the connecting channel 179 to the through bore 179*a* in a seal-tight manner.

The seals 191, 192 and 194 as well as the membrane foils 190 and 193 each have a basic shape coincident to the assigned side of the pump part. The seals therefore lie over the entire surface of the side assigned thereto except for the openings provided.

As shown in FIG. 3, a membrane plate 35 is attached to the membrane section 31 between the truncated-conical rise 103 of the pump cover 100 and the truncated-conical recess 91 of the pump center part 90. The membrane plate 35 includes an upper plate section 35*a* and a lower plate section 35*b*. The two plate sections 35*a* and 35*b* are connected to each other by an attachment screw 120 and the membrane section 31 is clamped tightly between the sections 35*a* and 35*b*.

Figure 4:
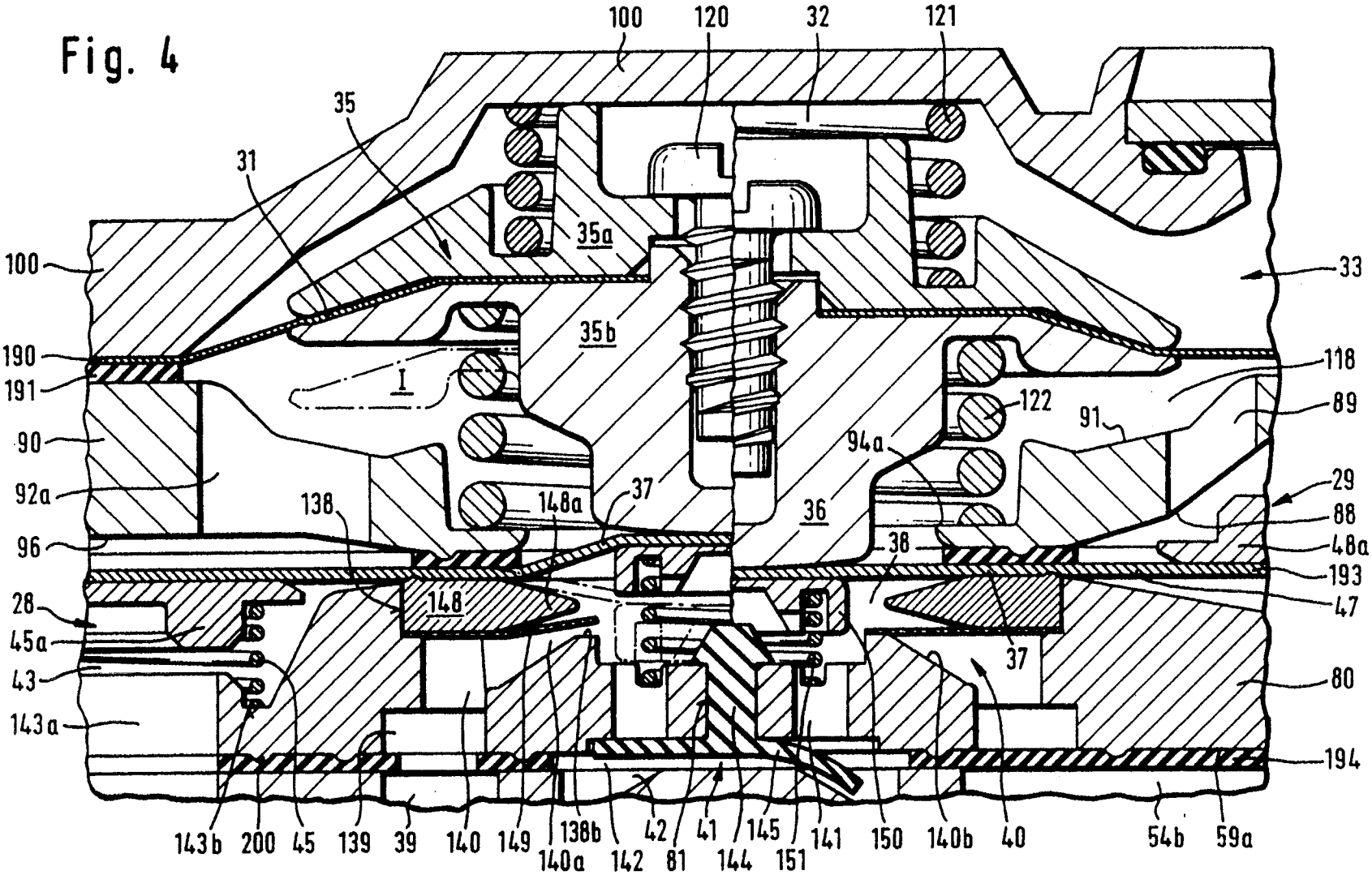
FIG. 4 is an enlarged section view through the pulse drive of the fuel pump.

As shown especially in FIG. 4, the lower plate section 35*b* is configured as a pump pin 36 which is in contact engagement with the membrane section 37 of the membrane 193 between the pump center part 90 and the pump lower part 80. The membrane section 37 is braced by a pump plate 150 which is resiliently biased by a helical spring 151 which is braced at one end in a recess of the center 138*a* (FIG. 14) of the pump lower part.

As shown in FIG. 4, a flexible foil such as a polyamide foil 149 lies on the upper annular shoulder 138*b* of recess 138 of pump lower part 80. The flexible foil covers the suction openings 140 as well as the ascending radial grooves 140*a* in a liquid seal-tight manner. The KAPTON foil 149 is held by a support ring 138 which has conically tapered fingers 148*a* which project radially inwardly. A displacement of the membrane section 37 in the direction toward the pump lower part 80 as well as a displacement of the KAPTON foil 149 in the direction toward the pump center part 90 is possible because of the conically extending fingers. The through bores 141 are disposed radially within the circle of suction openings 140 and the support ring 148. The through bores 141 are closed on the housing side 59*a* of the pump lower side 80 by a valve plate 145 of rubber or similar elastic material. The valve plate 145 is secured with a central lug 144 in the central attachment opening 81 of the recess 138.

The membrane plate 35 is held in a center position when the work chamber 32 is without pressure. This center position is determined in the illustrated embodiment by the two helical springs 121 and 122. The helical spring 121 is braced on the pump cover 100 and on the upper plate section 35*a*. The helical spring 122 operates as a counter spring and is braced on the lower plate section 35*b* as well as on the annular shoulder 94*a* of the pump center part 90. The helical spring 122 can be preferably omitted. The spring 121 then operates against stroke spring 151 arranged in the pump chamber 38 which is then to be configured correspondingly as a counter spring. In this way, the overpressure present in the work chamber 32 operates exclusively against the counter spring 122 or 151 with the spring rigidity being selected in correspondence to operating conditions. The helical spring 121 operates exclusively against an underpressure in the work chamber 32 with the spring rigidity being selected in correspondence to operating conditions.

The operating point of membrane 31 is adjusted by selecting the spring constants of springs (121, 151).

The left half of FIG. 4 shows a stroke movement in the direction toward the top dead point. With this stroke movement, the pump pin 36 relieves the membrane 37 which is lifted under the action of the stroke spring 151 above the pump plate 150 whereby fuel flows into the pump chamber 38 from the fuel feed 39 via the suction openings 140 and the suction grooves 140*a*. The polyamide foil 149 then operates in the manner of a check valve to clear the suction openings and the suction grooves.

The pressure store 128 is spatially arranged next to the suction openings 140. The compensating chamber 43 of the pressure store 128 is connected directly to the fuel feed 39. Accordingly, fuel can flow in from the suction store 28 during a suction stroke of the fuel pump 30 so that in a suction stroke, it is not necessary to accelerate the entire column of liquid from the suction openings to the fuel tank 10. The pump capacity of the fuel pump is improved in this way.

At the top dead point, the upper plate section is preferably in contact engagement with the pump cover so that the top dead point is also pregiven structurally.

With the downward movement of the membrane plate 35, the pump plate 150 is moved against the helical spring 151 into the pump chamber 38 via the membrane 37. The fuel is placed under pressure and is pumped via the through bores 141 into the fuel field 142 which is connected to the suction line 17 of the injection pump 11.

The bottom dead point is identified by I in the left-hand part of FIG. 4. The through-flow cross section of the pressure valve 42 is then less than the through-flow cross section of the suction valve 40 and preferably has a ratio of 1:3 to 1:5.

The membrane 37 delimiting the pump chamber 38 is configured as a single piece with the membrane 44 in the suction store 28 and the membrane 47 in the pressure store 29 and is illustrated by the membrane foil 193 between the pump lower part 80 and the pump center part 90. The membrane 44 in the suction store 28 is resiliently biased by spring 45 via a membrane plate 45*a*. The membrane 47 in the pressure store 29 is resiliently biased by the spring 48 via a membrane plate 48*a*. The spring 48 is braced in the pump center part 90 whereas the spring 45 is braced in the pump lower part 80.

The return chamber 118 is defined by the truncated-conical recess 91 in the pump center part 90. In the embodiment shown FIGS. 10 and 11, the return chamber 118 is between the work chamber 32 and the pump chamber 38 and communicates with the atmosphere. The return chamber of the suction store 28 is formed by the recess 96 and communicates via the opening 97 with the atmosphere and the rear chamber of the pressure store 29 formed by the recess 88 communicates via the opening 89 with the atmosphere.

In the schematic of FIG. 1, the rear chamber of the suction store 28 is connected via the opening 92*a* (FIG. 11) to the rear chamber 118 of the feed pump and the rear chamber of the pressure store 29 is connected via the opening 89 to the rear chamber 118 of the pump. The rear chamber 118 communicates with the atmosphere via a venting line 85 with the venting line being disposed in the pump parts 80 and 90. A filter foam 86 is held between the pump lower part 80 and the base housing 59 of the injection-pump block 9. The venting line 85 communicates with the atmosphere via the filter foam 86. Foreign particles are held back by the filter 86 and could otherwise lead to operational disturbances. The filter 86 is mounted in a field 300 on the housing side 59*a* of the pump lower part 80 and is clamped between the pump lower part 80 and the base housing 59. A chamber vented to the atmosphere is provided in the base housing. The venting line 85 opens via the filter 86 into this chamber.

As shown in FIG. 3, the work chamber 32 is partitioned relative to the rear chamber 118 by the membrane 31 formed by the membrane foil 190. A sealing pressing force is applied to the membrane foil 190 and the rubber seal 191 over the entire periphery of the work chamber 32, that is, in the region of the pulse channel 33 because of the strut 104.

The two pump parts 80 and 90 are made of plastic and, together with the pump cover 100 made of metal, are held together by attachment screws 64 so that the fuel pump can be assembled before assembly on the housing 59 of the injection-pump block 9. For this purpose, the attachment screws 64 are inserted from the housing side 59*a* of the pump lower part through the through bores 112 and into the pump parts and are threadably engaged in the attachment nuts 63 which are held in receptacles 110 so that they cannot rotate relative thereto. The heads 65 of the attachment screws lie recessed in the pump lower part.

As shown in FIG. 5, the recess 108 defines the rear chamber of the control chamber 73 in which membrane plate 75 is accommodated together with the actuating pin 76 projecting through the bore 177. The rear chamber communicates with the atmosphere via bore 109.

Figure 6:
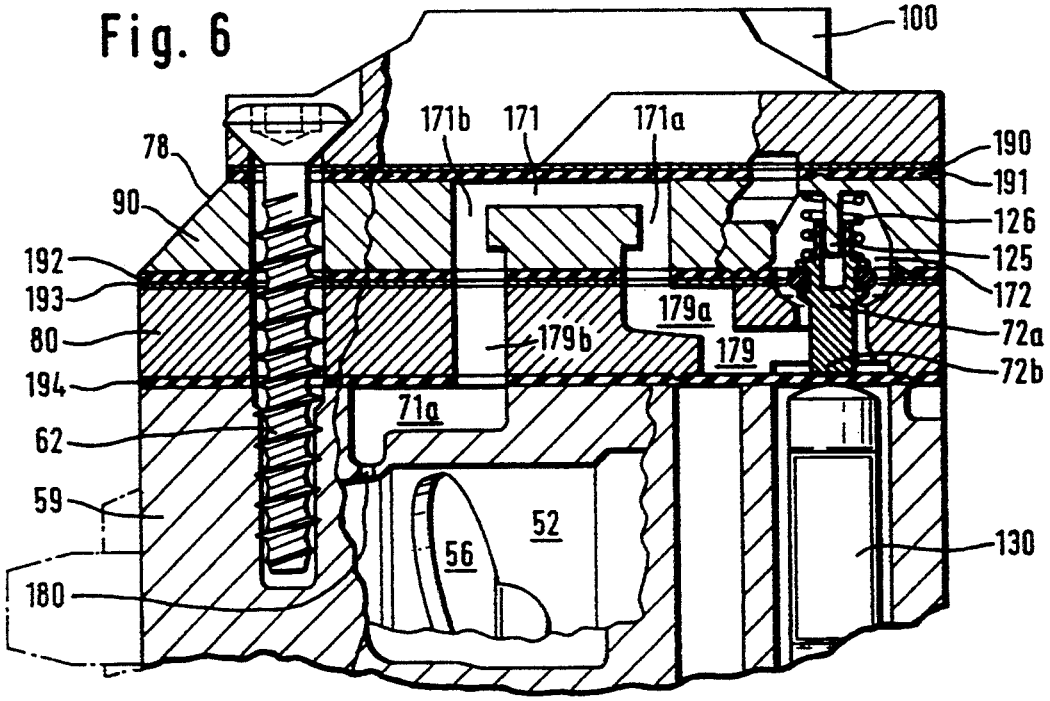
FIG. 6 is a section view through the fuel pump along the line 6—6 of FIG. 2.

A valve ball 77*a* of the feed valve 77 lies in the cylinder 99 of the pump center part 90. The valve ball 77*a* seals the bore 177 and is resiliently biased into its closed position by a spring 77*b*. The spring 77*b* is braced on the base of the receptacle 99*a*. The feed valve is connected to the pressure line 42 of the fuel pump and especially to the fuel field 142 shown in FIG. 13 via the fuel bore 177*a* in the base of the receptacle 99*a*. When the feed valve is open, fuel flows via the bore 177*a* into the control chamber 73 and, from there, via the breakthrough 95 (FIGS. 10 and 11) into the valve chamber 172 of the bypass valve 72. In the valve chamber, a valve member 72*a* is held so as to be axially displaceable on a guide pin 125 arranged perpendicularly in the valve chamber 172. A spring 126 holds the valve member 72*a* in seal-tight contact with the valve seat 178 configured in the pump lower part 80. A valve pin 72*b* is configured as one piece with the valve member 72*a* and projects through the valve bore 178*a* beyond the housing side 59*a* of the pump lower part 80. The valve pin 72*b* as well as the valve bore 178*a* are covered by the rubber seal 194. An actuating rod 130 is guided in the base housing. The bypass valve 72 can be manually switched via the actuating rod 130. In the open state, fuel from the control chamber 73 is drawn in by suction via the nozzle bore 180, the bypass channel section 71*a* in the base housing 59 as well as via the bores and channels described in the pump parts because of the underpressure in the intake channel section 52. When the bypass valve 72 is open, as shown in FIG. 6, an easy start of the engine is also then possible when air bubbles or vapor bubbles occur in the injection pump.

The pump parts 80, 90 and 100 are provided with the corresponding components and have the rubber seals (191, 192) as well as the membrane foils (190, 193). These pump parts (80, 90, 100) are assembled and held by the attachment screws 64. The preassembled fuel pump 30 is held on the housing 59 by means of screws 52 with rubber seals 194 inserted therebetween. The screws 62 are screwed into the base housing. Three screws 62 are provided on each longitudinal side of the fuel pump in order to obtain a tight contact engagement of all sealing struts. The fuel pump has an essentially rectangularly-shaped configuration when viewed in plan. The spacers 114 provided on the pump parts assure that no pressing forces are applied to the membrane layers or the rubber seals which are too great and protect the membrane layers and rubber seals from being destroyed.

It is understood that the foregoing description is that of the preferred embodiments of the invention and that various changes and modifications may be made thereto without departing from the spirit and scope of the invention as defined in the appended claims.

What is claimed is:

1. A fuel pump for supplying an injection pump for an internal combustion engine such as a two-stroke engine in a portable handheld work apparatus, the engine having a crankcase wherein pressure fluctuates during operation of the engine, the fuel pump comprising:

a housing defining an enclosed space;

a pump membrane mounted in said housing for delimiting a pump chamber in said space and said pump membrane being movable to reciprocate between first and second positions thereby defining a stroke direction;

said housing also defining a work chamber communicating with said crankcase for charging said work chamber with said pressure in said crankcase;

actuation means for translating the fluctuating pressure in said work chamber to a force for moving said pump membrane between said first and second positions;

a fuel feed for conducting fuel;

a suction valve for connecting said fuel feed to said pump chamber;

a pressure line for conducting fuel away from said pump chamber to said injection pump;

a pressure valve connecting said pump chamber to said pressure line;

said suction valve having a first end connected to said fuel feed and a second end facing toward said pump chamber;

said suction valve being formed in said housing so as to be disposed essentially along an arc of a circle at said second end thereby defining a center region at the center of said circle;

a shoulder formed in said housing and extending along said arc;

said suction valve including a plurality of suction openings uniformly distributed over the periphery of said shoulder; a plurality of radial grooves extending from corresponding ones of said suction openings to said center region; each of said radial grooves having a pregiven length and being open toward said pump chamber along said length; and, a movable valve member movable between a first position wherein radial grooves are tightly closed and a second position wherein said radial grooves are open to said pump chamber;

said pressure valve being arranged approximately in said center region of said suction valve so as to be in spaced relationship to said suction valve; and, said pressure valve delimiting said pump chamber in said stroke direction.

2. The fuel pump of claim 1, said pump chamber having an axial end face and the suction connection of said suction valve and the pressure connection of said pressure valve being on said axial end face.

3. The fuel pump of claim 1, said shoulder defining a plane; and, said grooves having respective groove bases which open at said plane of said shoulder.

4. The fuel pump of claim 1, said housing including a suction store formed therein; said fuel feed being connected to said suction store; and, said suction valve being disposed spatially close to said suction store and communicating with said suction store so as to be supplied therefrom.

5. The fuel pump of claim 4, said housing including a pressure store formed therein; and, said pressure line communicating with said pressure store.

6. A fuel pump for an internal combustion engine such as a two-stroke engine in a portable handheld work apparatus, the engine having a crankcase wherein pressure fluctuates during operation of the engine, the fuel pump comprising:

a housing defining an enclosed space;

a pump membrane mounted in said housing for delimiting a pump chamber in said space and said pump membrane being movable to reciprocate between first and second positions thereby defining a stroke direction;

said housing also defining a work chamber communicating with said crankcase for charging said work chamber with said pressure in said crankcase;

actuation means for translating the fluctuating pressure in said work chamber to a force for moving said pump membrane between said first and second positions;

a fuel feed for conducting fuel;

a suction valve for connecting said fuel feed to said pump chamber;

a pressure line for conducting fuel away from said pump chamber;

a pressure valve connecting said pump chamber to said pressure line;

said suction valve having a first end connected to said fuel feed and a second end facing toward said pump chamber;

said suction valve being formed in said housing so as to be disposed essentially along an arc of a circle at said second end thereby defining a center region at the center of said circle;

said pressure valve being arranged approximately in said center region of said suction valve so as to be in spaced relationship to said suction valve;

said pressure valve delimiting said pump chamber in said stroke direction;

said housing having a recess formed therein to define said pump chamber;

said recess having a deep center;

a plurality of through bores formed in said housing around the periphery of said deep center;

said pressure valve including a pressure valve member outside of said pump chamber and common to all of said through bores for closing said through bores;

said recess having an annular step formed therein disposed at a higher elevation than said deep center;

a plurality of suction openings distributed over a portion of said step; and, said suction valve having a suction valve member disposed in said pump chamber and common to all said suction openings for closing said suction openings.

7. The fuel pump of claim 6, said plurality of suction openings being defined by a plurality of radial grooves opening at said annular step; and, all of said radial grooves being adapted to be closed in common in a seal-tight manner by said suction valve member.

8. The fuel pump of claim 6, said housing having an attachment hole formed in the bottom of said recess at the center thereof; and, said pressure valve member being an elastic valve plate having a lug formed thereon and buttoned into said attachment hole.

9. The fuel pump of claim 6, said suction valve member being a foil ring lying in contact engagement with said annular step.

10. The fuel pump of claim 9, further comprising a support ring seated in said recess for holding said foil ring on said annular step and said foil ring having an outer diameter periphery and said support ring holding said foil ring at said outer diameter periphery; said support ring having radially inwardly directed star-shaped fingers which project approximately to the inner diameter of said annular step; and, said support ring having two end faces and said fingers being conically tapered away from said end faces.

11. A fuel pump for an internal combustion engine such as a two-stroke engine in a portable handheld work apparatus, the engine having a crankcase wherein pressure fluctuates during operation of the engine, the fuel pump comprising:

a housing defining an enclosed space;

a pump membrane mounted in said housing for delimiting a pump chamber in said space and said pump membrane being movable to reciprocate between first and second positions thereby defining a stroke direction;

said housing also defining a work chamber communicating with said crankcase for charging said work chamber with said pressure in said crankcase;

actuation means for translating the fluctuating pressure in said work chamber to a force for moving said pump membrane between said first and second positions;

a fuel feed for conducting fuel;

a suction valve for connecting said fuel feed to said pump chamber;

a pressure line for conducting fuel away from said pump chamber;

a pressure valve connecting said pump chamber to said pressure line;

said suction valve having a first end connected to said fuel feed and a second end facing toward said pump chamber;

said suction valve being formed in said housing so as to be disposed essentially along an arc of a circle at said second end thereby defining a center region at the center of said circle;

said pressure valve being arranged approximately in said center region of said suction valve so as to be in spaced relationship to said suction valve;

said pressure valve delimiting said pump chamber in said stroke direction;

said housing including a suction store formed therein;

said fuel feed being connected to said suction store;

said suction valve being disposed spatially close to said suction store and communicating with said suction store so as to be supplied therefrom;

said housing including a pressure store formed therein;

said pressure line communicating with said pressure store; and, said suction store, said pressure store and said pump chamber all being at approximately the same elevation in said housing.

12. A fuel pump for an internal combustion engine such as a two-stroke engine in a portable handheld work apparatus, the engine having a crankcase wherein pressure fluctuates during operation of the engine, the fuel pump comprising:

a housing defining an enclosed space;

a pump membrane mounted in said housing for delimiting a pump chamber in said space and said pump membrane being movable to reciprocate between first and second positions thereby defining a stroke direction;

said housing also defining a work chamber communicating with said crankcase for charging said work chamber with said pressure in said crankcase;

actuation means for translating the fluctuating pressure in said work chamber to a force for moving said pump membrane between said first and second positions;

a fuel feed for conducting fuel;

a suction valve for connecting said fuel feed to said pump chamber;

a pressure line for conducting fuel away from said pump chamber;

a pressure valve connecting said pump chamber to said pressure line;

said suction valve having a first end connected to said fuel feed and a second end facing toward said pump chamber;

said suction valve being formed in said housing so as to be disposed essentially along an arc of a circle at said second end thereof defining a center region at the center of said circle;

said pressure valve being arranged approximately in said center region of said suction valve so as to be in spaced relationship to said suction valve;

said pressure valve delimiting said pump chamber in said stroke direction;

said housing including a suction store formed therein;

said fuel feed being connected to said suction store;

said suction valve being disposed spatially close to said suction store and communicating with said suction store so as to be supplied therefrom;

said housing including a pressure store formed therein;

said pressure line communicating with said pressure store; and, said housing having a recess formed therein to define said pump chamber;

said pump membrane partitioning said space into a rear chamber and said pump chamber;

said fuel pump further including: a pump member movably mounted in said pump chamber to impart a pumping movement to said pump membrane; a support disposed in said recess; and, a displacement spring interposed between the support and said pump member to resiliently bias said pump member and said pump membrane in the direction of a suction stroke; said actuating means including an actuating membrane delimiting said work chamber and said rear chamber; said actuating membrane having a membrane plate and pin and said actuating membrane being actuated by said fluctuating pressure in said work chamber to impart a force to said pump membrane.

13. The fuel pump of claim 12, said displacement spring being a first displacement spring; and, said fuel pump further comprising a second displacement spring arranged in said work chamber and a third displacement spring arranged in said rear chamber for coacting with said second displacement spring to hold said membrane plate in a rest position when there is no pressure in said work chamber.

14. The fuel pump of claim 13, said rear chamber being dry and vented to the atmosphere.

15. The fuel pump of claim 14, said fuel pump comprising preassembled pump components in the form of three mutually congruent plates stacked one atop the other.

16. The fuel pump of claim 15, a first one of said plates being a pump cover made of metal, a second one of said plates being a pump center part made of plastic, and a third one of said plates being a pump lower part made of plastic.

17. The fuel pump of claim 16, said suction store and said pressure store being configured between said pump lower part and said pump center part.

18. The fuel pump of claim 17, said work chamber being configured between said pump center part and said pump cover.

19. The fuel pump of claim 18, said suction store and said pressure store having rear chambers, respectively, and said rear chamber between said work chamber and said pump chamber and said rear chambers of said suction store and said pressure store all being provided in said pump center part.

20. The fuel pump of claim 19, said suction store and said pressure store having membranes, respectively; and, said pump membrane, and said membranes of said suction store and said pressure store all being formed by a common membrane foil arranged between said pump lower part and said pump center part.

21. The fuel pump of claim 20, said pressure valve having a pressure end, said engine having an air intake channel; and, said fuel pump further comprising a bypass channel extending from said pressure end to said air intake channel; said bypass channel including: in series, a pressure controlled feed valve arranged in said pump center part; a manually switchable bypass valve; and, a plurality of openings, bores and grooves formed in said pump lower part and said pump center part to mutually interconnect and to conjointly define said bypass channel.

22. The fuel pump of claim 21, said pressure controlled feed valve having a control membrane; said control membrane of said feed valve and said actuating membrane being formed by a common membrane foil clamped between said pump cover and said pump center part.

23. The fuel pump of claim 22, said pump further comprising a first surface rubber seal clamped between said cover and said pump center part so as to be in contact engagement with the membrane foil therebetween; and, a second surface rubber seal clamped between said pump center part and said pump lower part so as to be in contact engagement with the membrane foil therebetween.

24. The fuel pump of claim 23, one side of each of said pump lower part and said pump center part having struts formed thereon to subdivide said side into mutually partitioned fields; and, said rubber seals lying on said one side of said pump lower part and said pump center part, respectively.

* * * * *